US005890409A

United States Patent [19]

Carlton et al.

[11] Patent Number: 5,890,409

[45] Date of Patent: Apr. 6, 1999

[54] SLOTTING BLADE WITH OUT-OF-PHASE SERRATIONS

[75] Inventors: Ian S. Carlton, Roscoe; Cedric W. Blazer, Rockford, both of Ill.

[73] Assignee: Zenith Cutter Co., Rockford, Ill.

[21] Appl. No.: 859,667

[22] Filed: May 20, 1997

[51] Int. Cl.[6] ..... B26D 1/12

[52] U.S. Cl. ..... 83/678; 83/332; 83/676; 83/698.41; 144/136.1; 144/218; 144/240

[58] Field of Search ..... 83/332, 665, 676, 83/678, 695, 698.41, 835, 837, 846, 847, 852, 876, 877; 144/89, 91.2, 136.1, 201, 203, 218, 236, 240

[56] References Cited

U.S. PATENT DOCUMENTS

| | | | |
|---|---|---|---|
| 229,772 | 7/1880 | Suisse . | |
| 2,644,494 | 7/1953 | Lundberg . | |
| 2,757,697 | 8/1956 | Simmons et al. . | |
| 3,651,841 | 3/1972 | Ohlsson | 143/133 R |
| 3,899,955 | 8/1975 | Selch | 90/11 A |
| 4,024,785 | 5/1977 | Jansen-Herfeld | 83/848 |
| 4,167,884 | 9/1979 | Santanna | 83/671 |
| 4,819,534 | 4/1989 | Sanchez | 83/671 |

*Primary Examiner*—Peter Vo
*Assistant Examiner*—Kevin G. Vereene
*Attorney, Agent, or Firm*—Leydig, Voit & Mayer, Ltd.

[57] ABSTRACT

A durable male slotting blade for creating cleanly sheared slots in corrugated cardboard. The male slotting blade is adapted to be mounted to a slotter head of a cardboard box fabricating machine, and is provided with a cutting surface having first and second sets of serrations. A first set of serrations is provided on one side of the cutting surface while a second set of serrations is provided on an opposing side of the cutting surface with a valley formed therebetween. The first set of serrations are provided offset from, or out-of-phase with, the second set of serrations to provide for a cleaner cut with less frayed edges. Each of the serrations includes a peak and a valley machined not only into the sides of the cutting surface but also down into the valley formed in the cutting surface such that as the blade encounters abrasive recycled fibers, and is worn away, a new cutting surface is repetitively provided to thereby result in a longer lasting and more durable blade.

4 Claims, 2 Drawing Sheets

SLOTTING BLADE WITH OUT-OF-PHASE SERRATIONS

FIELD OF THE INVENTION

The present invention generally relates to knives or blades, and more particularly relates to slotting blades for forming slots in corrugated cardboard.

BACKGROUND OF THE INVENTION

Medium and heavy duty packaging boxes are typically manufactured from corrugated cardboard. Corrugated cardboard sheet stock is cut into appropriate dimensions, slots and folds are created in the cardboard at appropriate positions, and two ends of the cardboard are glued together to form a continuous loop. These operations are typically performed in a commercially available machine capable of performing all of the folding, slotting, and gluing operations. The resulting product is then shipped to the customer who then folds the cardboard at the appropriate positions to form a normally rectangular tube, and uses the flaps created by the slots to form the two ends of the box.

With corrugated cardboard which is manufactured from 100% virgin paper fibers, the slots are typically formed using slotting blades having sharpened edges separated by a gap corresponding to the width of the desired slot. One or more slotting blades are mounted in a rotating slotter head above the level of the cardboard sheet stock and between two female blades located below the cardboard sheet stock. The outer sides of the male blade interact with the interior sides of the female blades to shear the slot from the cardboard in a scissor-like fashion. Since the natural fibers are relatively weak, the slots formed are relatively clean with few fibers pulled from the cardboard, and little fraying of the edges.

However, with today's marketplace, it is uncommon to manufacture corrugated cardboard from 100% virgin paper fibers. Corrugated cardboard is now commonly manufactured from a combination of virgin paper fibers, recycled paper fibers, and synthetic fibers. Conventional slotting blades used to create slots in 100% natural fiber cardboard cannot create a cleanly shaped slot in that the recycled paper fibers are often not cleanly severed by the slotting blade. Rather, the recycled paper fibers are grasped by the male slotting blade and pulled from the cardboard sheet stock resulting in frayed edges and a non-uniformly shaped slot.

Since the ultimate end users of the cardboard boxes are often from the food industry, or other industries where cleanliness, and the appearance of cleanliness, are of utmost importance, such frayed edges are not acceptable. They create not only the impression that the box is sloppy, but also that the product inside is also sloppy and less than aesthetically desirable.

More recent prior art blades have incorporated the use of teeth or serrations along the cutting edges which are better equipped to cut through cardboard than are conventional blades having curvilinear cutting surfaces. The machining procedures used to form the blades typically result in serrations on both sides of the cutting blade which are aligned in matching sequence such that corresponding serrations penetrate the cardboard along the same axis line across the slot. Therefore, the profile of each side mirrors the other side and results in fewer locations around the blade at which the serrations perforate and penetrate the cardboard. This results in less complete shearing of the slot, more pulling of fibers from the sides of the cardboard adjacent the slot, and thus more frayed edges.

In addition, with the increased use of recycled fibers in the production of corrugated cardboard, the blades used to create the slots in the cardboard are confronted with increasingly abrasive fibers which eventually fragment the cutting edges and dull the blade. Conventional blades are provided with sharpened edges only at the joints between the cutting surface and the opposing sides, and once these are fragmented or worn down, their cutting efficacy is lost. While the more recent blades alluded to above do include serrations along the cutting edges, the serrations are also only along the edges, and once they are fragmented or worn down, their cutting efficacy is lost as well.

SUMMARY OF THE INVENTION

It is a primary aim of the present invention to provide a male slotting blade capable of creating cleanly sheared slots in a wide range of cardboard sheets, including recycled cardboard sheets.

It is an objective of the present invention to provide a durable male slotting blade which is able to resist the abrasive effects of the recycled fibers contained within recycled cardboard sheets.

In accordance with these aims and objectives, it is a feature of the present invention to provide a male slotting blade having a cutting surface with two sets of serrations. One set of serrations is provided adjacent one side of the cutting surface while the second set of serrations is provided adjacent the second side of the blade with a valley formed therebetween. The blade is thereby able to more cleanly shear the slot from the cardboard without producing frayed edges.

Another feature of the present invention is to provide a male slotting blade having a cutting surface with one set of serrations provided on one side of the cutting surface, and a second set of serrations provided on the other side of the cutting surface which are offset from, or out-of-phase with, the first set of serrations to increase the clean shearing effects of the slotting blade.

It is yet another feature of the present invention to machine the serrations not only along the sides of the cutting blade but also down into a valley formed between the serrations. Therefore, as the cutting edges are fragmented and worn away by the recycled fibers, the blade is able to provide a sharp cutting surface throughout the depth of the serrations and thereby provide a longer lasting and more durable blade.

These and other objectives and advantages of the invention will become more apparent from the following detailed description when taken in conjunction with the accompanying drawings.

Figure 1:
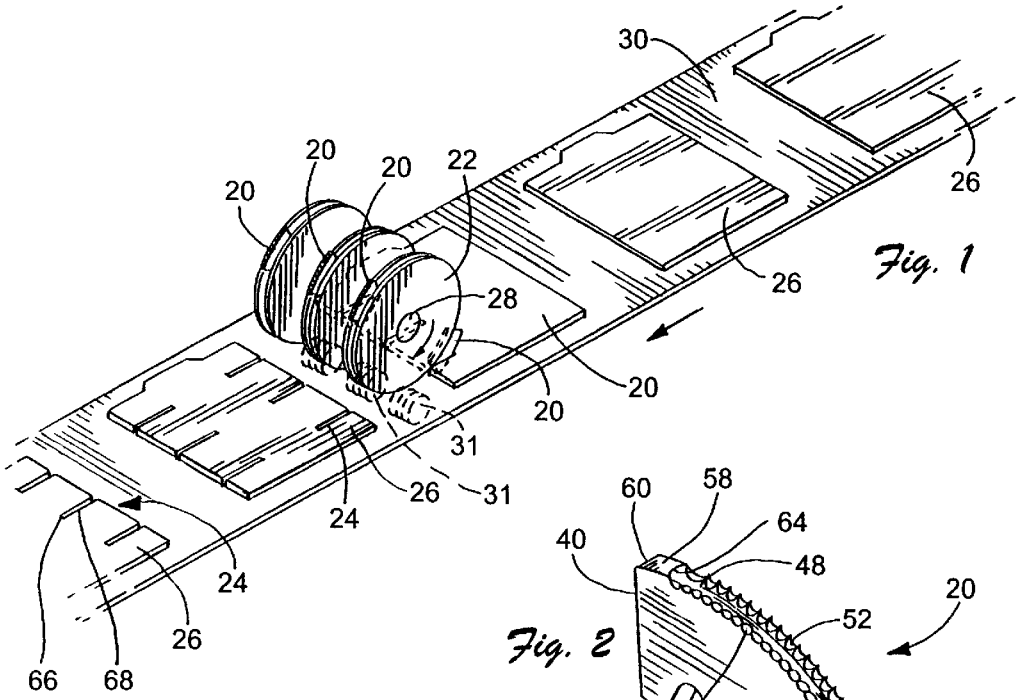
FIG. 1 is a perspective view of the present invention mounted to a slotter head for producing slots in cardboard sheets.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Referring now to FIG. 1, there is shown in very schematic fashion a slotting system which illustrates the principles of operation of a slotter head 22 as it interacts with cardboard sheets 26 to form slots 24 therein. A male slotter blade 20 is shown mounted into slotter head 22 as it would be under operating conditions for creating slots 24 in corrugated cardboard sheets 26. As is conventional, when slotter head 22 rotates about axis 28, and cardboard sheet 26 is fed along table 30, blade 20 engages cardboard sheet 26 to produce slots 24. Female rolling blades 31 are provided to receive male blade 20 therebetween to cut cardboard 26 in a scissor-like fashion as will be described in further detail below.

Although not shown, those of ordinary skill in the art will realize that slotter head 22 will be mounted to a rotating shaft and provided with a mechanism for accommodating numerous blades. Moreover, those of ordinary skill in the art will realize that cardboard sheets 26 will be fed across table 30 at a rate calculated to place slots 24 in the desired positions, and that the aforementioned rate will be calculated and controlled by a numerical controller or central processor having conventional operator input capabilities.

After slots 24 are formed in cardboard sheet 26, and sheet 26 is provided with folds at appropriate positions, sheet 26 can be formed into a box or package. Since corrugated cardboard boxes are commonly used to package food products, it is important that slots 24 be formed in cardboard 26 with clean lines and unfrayed edges. Purchasers of cardboard boxes are demanding such requirements because a box with frayed edges may appear aesthetically unsightly and result in a less than sanitary image for their product.

Today, cardboard boxes are being manufactured from cardboard which is commonly manufactured from recycled fibers or a blend of recycled fibers with virgin fibers. Recycled fibers may include not only paper fibers, but synthetic fibers as well. It is the short recycled paper fibers and the synthetic fibers within the recycled cardboard which have proven to be difficult to cut with conventional slotted blades and still result in edges which are unfrayed.

Figure 2:
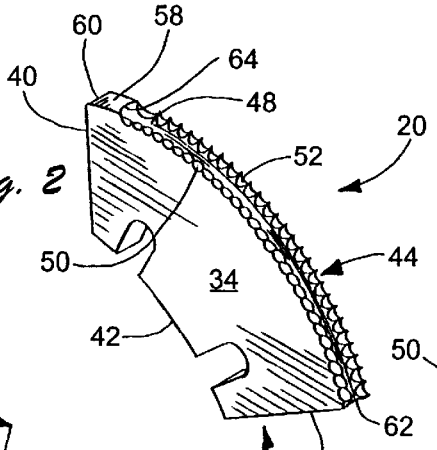
FIG. 2 is a perspective view of the present invention.

In accordance with the invention blade 20 is specially configured to more effectively cut slots in cardboard sheets, even those containing synthetic fibers. As best shown in FIG. 2, blade 20 includes arcuate plate 32 having front side 34, opposed back side 36, first end 38, second end 40, mounting surface 42, and cutting surface 44. In one implementation arcuate plate 32 spans an arc of about 57°, although different arcs are possible depending on the shape and length of slot 24 desired. Also in the preferred embodiment, plate 32 is formed from tool steel having a ROCKWELL C™ hardness rating of 58–60. This allows for a relatively cost effective blade with enhanced wear characteristics.

Figure 3:
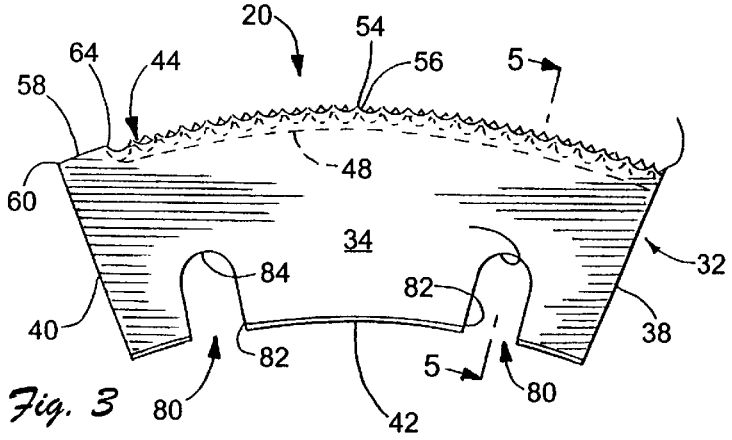
FIG. 3 is a side view of the present invention.

As can be seen from FIG. 2, cutting surface 44 is provided with a multitude of serrations disposed on both sides of channel 48. A first set of serrations 50 is aligned with left side 34, while a second set of serrations 52 is aligned with right side 36. Turning now to FIG. 3, it can be seen that each serration is comprised of a peak 54 and a valley 56 with a given distance between peaks 54; in the preferred embodiment, the distance being approximately 3/16".

Figure 4:
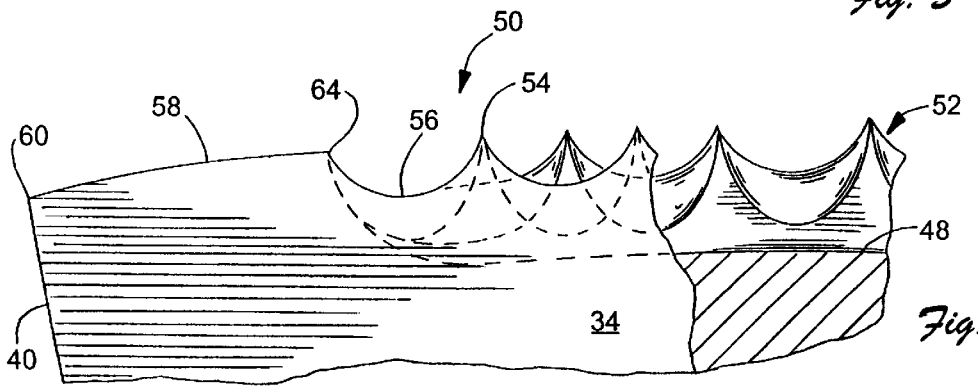
FIG. 4 is an enlarged side view of the serrations and hammer portion with a portion of the front side cut away to show the back side in cross-section.

Also shown in FIG. 3, as well as FIG. 4, first set of the serrations 50 on one side of the channel 48 are not aligned with the second set of serrations 52 on the other side of the channel. Rather, first set of serrations 50 and second set of serrations 52 are out-of-phase with one another by 180°, the importance of which will be discussed with further detail below. Also shown in FIGS. 2 and 3, cutting surface 44 further includes hammer portion 58 adjacent leading edge 60. Channel 48 extends from trailing edge 62 to hammer portion 58 so that a transverse cutting edge 64 is formed as a mechanism for creating end cut 66 in slot 24. If not for hammer portion 58, slot 24 would be formed with side cuts 68, but with no mechanism for creating end cut 66 and therefore slots 24 would remain hingedly attached to cardboard sheet 26. As best shown in FIG. 1, cutting edge 64 is contiguous with first set of serrations 50 and second set of serrations 52 to thereby create end cut 66.

Figure 5:
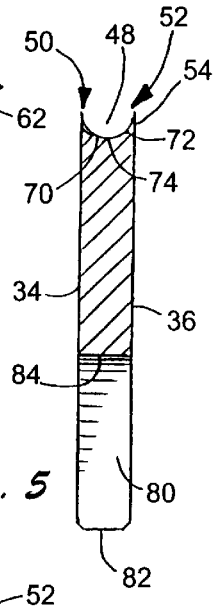
FIG. 5 is a cross-sectional end view of the present invention taken along line 5—5 of FIG. 3.
Figure 6:
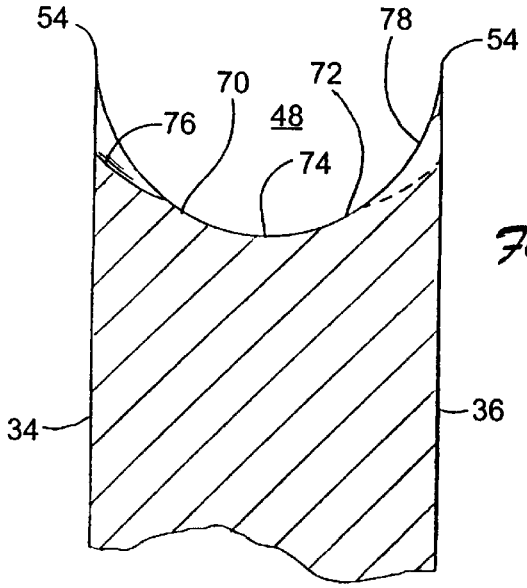
FIG. 6 is an enlarged sectional view of the channel and serrations shown in FIG. 5.

Referring now to FIGS. 5 and 6, channel 48 is shown having front angled side 70 and adjoining back angled side 72 which share mutual base 74. It is in front angled side 70 and back angled side 72 as well as left side 34 and right side 36 that first set of serrations 50 and second set of serrations 52 are formed.

As will be appreciated by comparing FIGS. 5 and 6, each peak 54 and each valley 56 is formed not only in left side 34 and right side 36 of plate 32, but also extend inwardly from sides 34 and 36 across front angled side 70 and back angled side 72. Valleys 56 extend across the angled side toward base 74 and form pockets 76, while peaks 54 also extend across angled sides toward base 74 to form bevels 78. Thus the peaks and valleys are sharply formed in the place of the side 34 or 36, but are contained toward the valley 74 in the blade center. Therefore, cutting surface 44 can provide a sharp cutting edge not only at the juncture between sides 34 and 36 with cutting surface 44, but also along the entire depth of pocket 76 and bevel 78. Lower depths of pockets 76 and bevels 78 are accessed as blade 20 is used and becomes worn. The present invention therefore provides for a longer lasting, sharper, cutting surface 44.

Turning now to the significance of offset serrations 50 and 52, it can best be seen from FIG. 3 that each peak 54 and each valley 56 of left side 34 are out-of-phase with each peak 54 and each valley 56 at right side 36. As opposed to conventional slotting blades which simply have a cutting surface perpendicular to the sides of the blade with the edges therebetween being sharpened and cooperating with female rolling blades to cut the cardboard in a scissor-like fashion, the present invention also uses serrations 50 and 52 to puncture and penetrate cardboard sheet 26 more easily than is possible with conventional blades. For example, with a conventional blade, the cutting edges are substantially linear and the whole cutting surface engages the cardboard at the same time tending to push the slot from the cardboard. This pushing effect tends to pull fibers from the cardboard sheet adjacent the slot to result in frayed edges. However, by providing serrations 50 and 52, blade 20 of the present invention is more easily able to penetrate and pass through cardboard sheet 26, in that peaks 54 initially engage sheet 26 and drive through the cardboard along the edges provided by valleys 56.

With the present invention, this effect is enhanced through the provision of two sets of serrations 50 and 52 which are provided in cutting surface 44, divided by channel 48, and disposed in an out-of-phase orientation. As opposed to blades with in-phase serrations, the side profile of the present invention showing the serrations 50 and 52 as in FIG. 3 is more jagged, wherein each serration 50 is separated, in side profile, by a serration 52 disposed across channel 48. This results in penetration of cardboard 26 by serrations 50 and 52 at more locations along the longitudinal axis of slot 24 to thereby lessen the pushing effect of blade 20 on slot 24, and enhance the perforation and shearing effect.

This effect is even more pronounced if cardboard 26 contains fibers long enough to span the width of slot 24. In such a situation, the fibers will likely not span across slot 24 such that they align with in-phase serrations. In fact, the fibers might be situated such that peaks of the serrations straddle the given fiber and are therefore not able to penetrate the fiber. However, with the present invention, the side profile of the serrations is doubly jagged to thereby double the locations along the longitudinal axis of slot 24 at which serrations 50 and 52 penetrate cardboard 26. This necessarily doubles the likelihood of the fibers being engaged, and sheared by, a serration 50 or 52.

Blade 20 further includes mounting surface 42 opposite cutting surface 44. As best shown in FIGS. 1 and 3, mounting surface 42 is an arcuate surface having an arc of 57° in the preferred embodiment matching the arc of cutting surface 44. Mounting surface 42 includes a pair of notches 80 having entranceways 82 and semicircular ends 84. In the preferred embodiment entranceways 82 are manufactured to be 9/16" wide to receive conventional T-bolts of slotter head 22, while in alternative embodiments, tapped and untapped holes of various diameters are similarly used. It is of course possible that a different number of notches 80, or a notch having a different width or shape, can be used depending on the type of slotter head to which blade 20 is to be mounted.

In operation, blade 20 is mounted into rotatable slotter head 22 such that blade 20 will engage cardboard sheet 26 to form slots 24 as sheets 26 proceed along table 30. Blade 20 engages cardboard sheet 26 between a pair of female rolling blades 31. Left side 34 and right side 36 of blade 20 cooperate with the interior sides of female blades 31 to act in a scissor-like fashion to cut slot 24 from cardboard 26. Sheets 26 are sequenced along table 30 such that leading edge 60 of blade 20 engages the leading edge of cardboard sheet 26. At the end of the revolution of blade 20, hammer portion 58 engages cardboard sheet 26 and cutting edge 64 slices through cardboard sheet 26 to create end cut 66 and completely form slot 24.

As blade 20 is continually used, the abrasive texture of cardboard 26 will eventually wear blade 20 such that portions of serrations 50 and 52 are fragmented away. However, given the formation of peaks 54 and valleys 56, with corresponding pockets 76 and bevels 78, cutting surface 44 is repetitively provided with a sharp cutting surface even as portions of serrations 50 and 52 are fragmented away. This results in a much more durable blade than is available in the prior art and ultimately manifests its significance in cost savings to the user.

Moreover, by providing serrations 50 and 52 which are out-of-phase with one another, the resulting cut formed by blade 20 is much cleaner and less frayed than is possible through prior art slotting blades. The serrations 50 and 52 penetrate cardboard 26 at more locations along the longitudinal axis of slot 24 to immediately sever the fibers of cardboard 26 at more locations such that as blade 20 continues its rotation through cardboard 26, the pushing effect of blade 20 on slot 24 is lessened, and the shearing effect is enhanced. Since pushing tends to pull fibers from the sides of cardboard 26 adjacent slot 24 and results in frayed edges, and shearing does not, the present invention consequently results in fewer frayed edges.

The configuration of the serrated teeth and their relationship to each other along an edge of the blade and between edges, is not arbitrary or a simple of choice; indeed, the process of forming the teeth can be simple or quite complex, depending on the nature of the teeth desired. For example, straight sawtooth teeth are relatively easy to cut as by milling across the blade for each tooth, and in addition it is relatively straightforward to form teeth which are in-phase by continually passing a milling or grinding tool across a blade from edge to edge to form each tooth. In order to form the outer phase serrated and sloped teeth of the present invention, however, requires a special machining process which will now be described.

Figure 7:
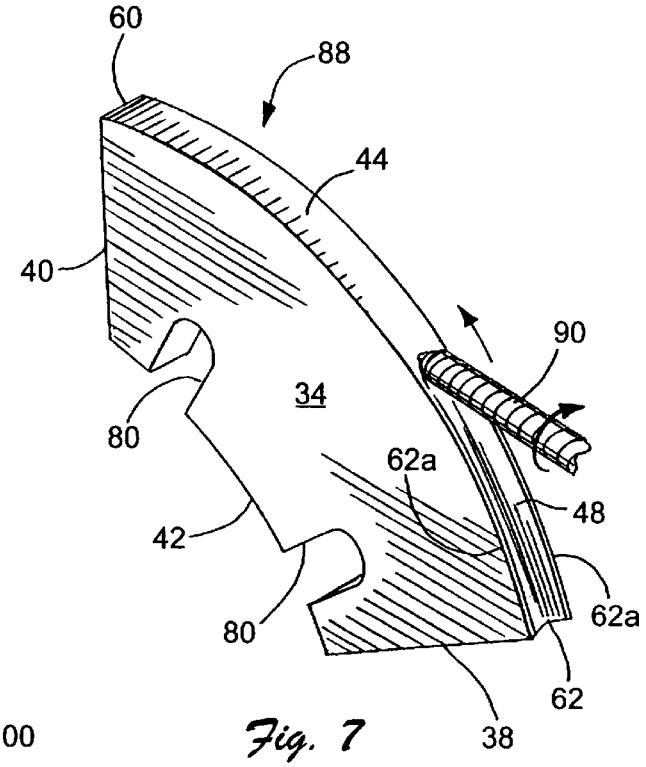
FIG. 7 is a perspective view of the channel being formed in a blade blank.
Figure 8:
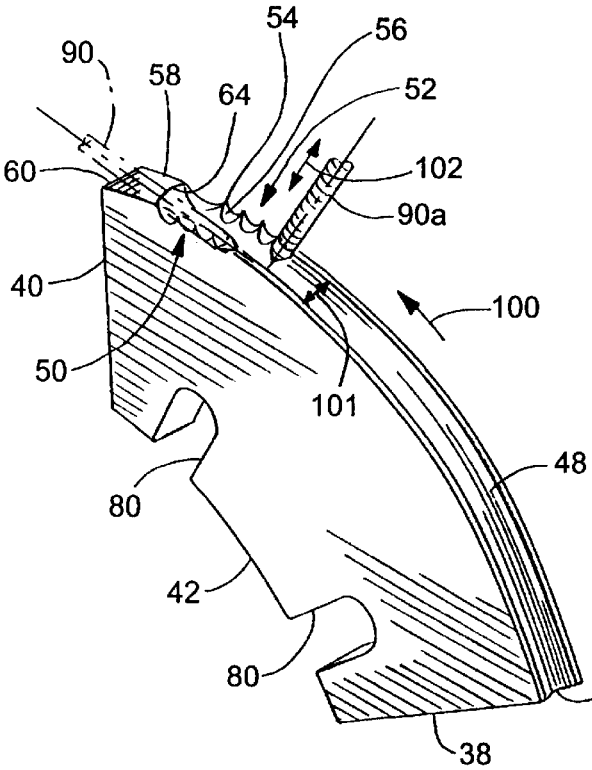
FIG. 8 is a perspective view of the serrations being formed in a blank having a channel already formed therein.

Thus, the present invention also encompasses the method by which the above described slotting blade is manufactured, as is diagrametrically illustrated in FIGS. 7 and 8. FIG. 7 illustrates an initial milling operation starting with an arcuate blank. A rotating milling tool 90, engages the blank 34 in order to form an arcuate slot 62. The tool 90 is a ball-end mill and has a diameter, and is set to penetrate the edge 44 of the blank so as to form two sharp edges at the respective walls. The edges are not serrated at this point. In practice, the blank 34 is mounted in a work holder so as to rotate about the center of the arc as the ball mill 90 engages the edge 44 to form the arcuate channel 62 in the center thereof. The tool 90 is extracted from the workpiece before the end thereof in order to form the hammer 58.

After forming the center channel 62, a smaller ball-end mill is utilized to form the serration in the originally smooth cutting edge. It will be appreciated that the serrations can be formed using a multiple axis milling tool, the motions of which are diagrametically illustrated by arrows in FIG. 8. Thus, as the workpiece 34 is rotated about the center arc as illustrated by arrow 100, the tool 90*a* and the workpiece 34 are caused to make a complex nutating-like motion with respect to each other to form the offset serrated edges. Thus, as the workpiece 34 is rotated about its center as indicated by arrow 100, the workpiece 34 is moved edge to edge as indicated by arrow 101 as the tool 90*a* is moved in and out as indicated by arrow 102 so that the serrations between the teeth are formed. Thus, the points of the teeth 54 are at about the same level as the edges 62*a* of the piece as it was formed in FIG. 7. Material is removed by the tool 90*a* to form serrations between adjacent peaks. It will be appreciated that the diameter of the ball and mill 90*a* determines the distance between the peaks. After the tool 90*a* penetrates the end wall to form the valley 56 between peaks 52, the workpiece 34 and tool 90*a* are moved so that the end mill moves toward the center of the channel and simultaneously toward the rotational center of the workpiece 34 to form the slopped serration. The workpiece 34 continues to rotate as indicated by arrow 100, and the milling tool 90*a* then begins to approach the other edge at which point the complex motion created by the multiple axis milling machine causes the tool 90*a* to begin to withdraw along the radius of the workpiece 34 as the tool 90*a* begins to approach the opposite edge to form a pair of peaks separated by a valley on the opposite edge. By virtue of the coordinated rotation along axis 100, those peaks and valleys are formed 180° out of phase with respect to the previously formed pair on the opposite edge. Thus, the workpiece and tool continue to perform this nutating-like motion as the workpiece 34 is rotated, until the entire slot 62 has been machined by this second operation to form two smoothly serrated edges along opposite ends of the workpiece with peaks of the serrations being about 180° out of phase on the respectively edges.

In view of the foregoing it can be appreciated that the present invention brings to the art a new and improved male slotting blade for producing slots within recycled corrugated cardboard which is not only more durable and longer lasting than is available through the prior art, but which also results in a cleaner, less frayed, and more uniformly shaped slot. Since the blade is more durable in that the cutting surfaces are machined into the blade to allow progressively deeper sections of the cutting surfaces to be accessed as the blade is repetitively used, the blades need not be replaced as often as with prior art devices. This results in cost savings not only to the box manufacturer but also to the end user of the box. By producing a more cleanly formed slot, the boxes resulting from the slotting operation have a cleaner appearance and more aesthetic appeal not only to the manufacturers using the boxes for packaging, but also to the ultimate customer.

What is claimed is:

1. A slotting blade for use in manufacturing corrugated cardboard boxes, comprising:

an arcuate plate having first and second opposed sides, first and second ends, a cutting surface, and a mounting surface, the first and second sides being parallel and the first end, second end, cutting surface, and mounting surface being disposed transverse to the first and second opposed sides;

a first plurality of serrations provided on the cutting surface and being aligned with the first opposed side; and a second plurality of serrations provided on the cutting surface and being aligned with the second opposed side, the second plurality of serrations being out-of-phase with the first plurality of serrations; and a channel in the cutting surface between the first and second plurality of serrations, the channel having first and second angled sides which extend from the first and second opposed sides downward toward a mutual base;

the first end and the cutting surface meeting to define a leading edge, the second end and the cutting surface meeting to define a trailing edge, the cutting surface including a hammer portion adjacent the leading edge, the channel extending from the hammer portion to the trailing edge, and the hammer portion being sharpened to provide a cutting edge transverse to the first and second pluralities of serrations.

2. The slotting blade of claim 1 further including means for mounting the slotting blade to a rotatable slotter head.

3. The slotting blade of claim 2, wherein the mounting means includes at least one slot formed in the mounting surface which is adapted to receive a fastener of the rotatable slotter head.

4. The slotting blade of claim 1, wherein each serration includes a peak and a valley, each peak and valley being formed in an opposed side, and extending along an adjoining angled side toward the base, and thereby defining the depth of each serration, each serration being sharpened along its entire depth to provide a continuously sharpened cutting surface as the serrations are worn down through use.

* * * * *